United States Patent [19]

Jackson

[11] 4,348,809

[45] Sep. 14, 1982

[54] COMBINATION SHARPENER DEVICE AND SCISSORS

[75] Inventor: Dennis B. Jackson, Nunawading, Australia

[73] Assignee: Wiltshire Cutlery Company Proprietary Limited, South Melbourne, Australia

[21] Appl. No.: 95,264

[22] Filed: Nov. 19, 1979

[51] Int. Cl.[3] ..... B24B 3/52

[52] U.S. Cl. ..... 30/138; 76/82.2; 51/214

[58] Field of Search ..... 76/82, 86, 88, 82.2; 51/205 WG, 214, 204, 211 H; 30/138

[56] References Cited

U.S. PATENT DOCUMENTS

| | | | |
|---|---|---|---|
| 1,968,424 | 7/1934 | Rous | 51/211 H |
| 3,875,825 | 4/1975 | Buttafuoco | 76/88 |
| 4,041,651 | 8/1977 | Bayly | 76/82 |

*Primary Examiner*—Roscoe V. Parker
*Attorney, Agent, or Firm*—Ladas & Parry

[57] ABSTRACT

An apparatus for sharpening scissors and similar two bladed cutting implements in which both blades are sharpened simultaneously with the scissors kept in the closed condition. The apparatus includes a hollow housing containing a pair of blade sharpeners, at least one of which is mounted for movement towards and away from the other and is spring influenced towards the other. The or each movable sharpener is carried at a front end of a elongate member which extends rearwardly into the housing and is movable about an axis located at or adjacent its rear end. Sharpening is effected by passing the closed scissors between the two sharpeners so that the cutting edge of each blade is treated by a respective one of the sharpeners and each sharpener serves to remove material simultaneously from the cutting edge of one blade and the back edge of the other blade.

12 Claims, 7 Drawing Figures

COMBINATION SHARPENER DEVICE AND SCISSORS

This invention relates to apparatus for sharpening scissors, shears, and similar cutting implements having two pivotally connected blades. As a matter of convenience however, the invention will be hereinafter particularly described with reference to scissors, so that the term "scissors" as used throughout this specification is to be understood as embracing shears and other pivotted blade implements.

Sharpening of scissors has been a long standing problem, and prior to the present invention has been performed by treating each blade separately. If each blade is to be sharpened over its entire length, it is generally necessary to physically separate the blades for that purpose. Because of those difficulties, sharpening is inconvenient and is not always effectively achieved, with the result that, for some applications, the useful life of scissors is severely restricted.

It is a primary object of the present invention to provide a device for sharpening scissors and the like, in a convenient and effective manner, and in particular to permit sharpening of both blades in a single operation.

According to one aspect of the present invention there is provided a sharpening device for scissors including, a hollow housing for receiving scissor blades, a pair of sharpener units located within said housing adjacent an open front end thereof and being arranged in opposed relationship to receive said blades between them, means mounting at least one said sharpener unit for movement towards and away from the other, and biasing means acting on said movable sharpener unit to urge it in a direction towards the other said sharpener unit.

According to a further aspect of the invention, there is provided a method of sharpening scissors including the steps of, closing the blades of said scissors so that the cutting edge of each blade is in substantially the same plane as the back edge of the other said blade, and passing said blades between the pair of sharpener units each of which operates to simultaneously remove material from a respective said cutting edge and the adjacent said back edge.

The essential features of the invention, and further optional features, are described in detail in the following passages of the specification which refer to the accompanying drawings. The drawings however, are merely illustrative of how the invention might be put into effect, so that the specific form and arrangement of the features (whether they be essential or optional features) shown is not to be understood as limiting on the invention.

Figure 1:
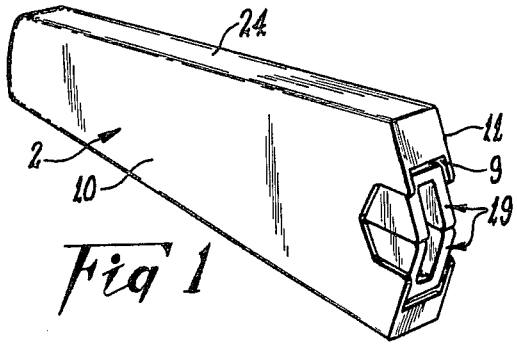
FIG. 1 is a perspective view of one embodiment of the invention.

A sharpening device according to the invention and as shown in the drawings includes a housing 2 and a pair of sharpener units 3 arranged within the housing 2 in opposed relationship. At least one unit 3 is mounted for movement towards and away from the other, and it may be biased by a spring 4 so as to be influenced in the former direction. The arrangement is such that scissor blades 5 and 6 in the closed condition can be received between the sharpener unit 3 (FIG. 3), and the two blades 5 and 6 are sharpened simultaneously during movement of the blades 5 and 6 relative to the sharpener units 3. That is, the blades 5 and 6 are sharpened as they are moved into and out of the housing 2. Obviously, the inventive concept can be adapted to many different constructions, and the construction shown is an example only.

The housing 2 is hollow and is preferably closed on all sides and a rear end so as to provide a scabbard or enclosure for the scissors 7 such as to protect the blades 5 and 6 when not in use. An elongate blade receiving passage 8 is defined within the housing 2, and the scissor blades 5 and 6 are moved into the passage 8 through the open front end 9 of the housing 2. If desired, at least part of one of the side walls 10 and 11 of the housing 2 may be movable or removable to permit access to the interior for the purpose of maintenance such as cleaning and repair or replacement of the sharpener units 3. That facility may be particularly useful in the embodiment of FIG. 7.

Figure 4:
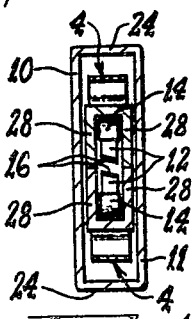
FIG. 4 is a cross-sectional view taken along line IV—IV of FIG. 2.
Figure 6:
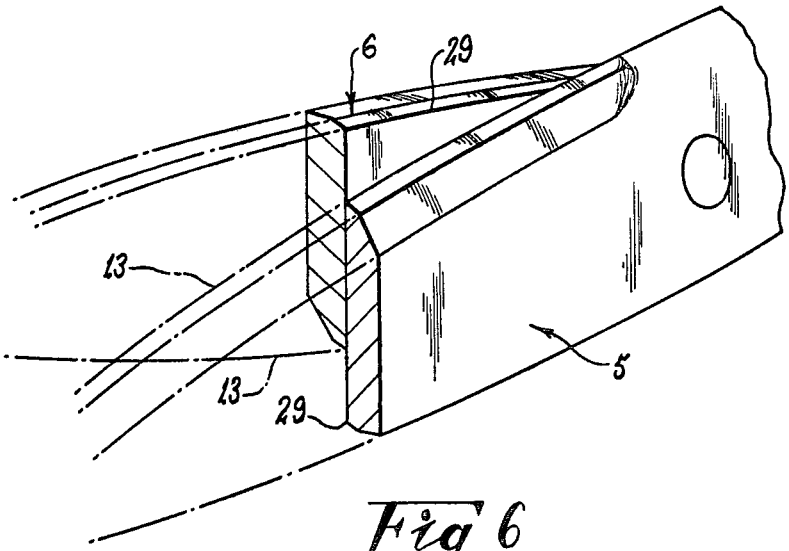
FIG. 6 is a perspective view of part only of scissors of the kind shown in FIG. 3.

Each sharpener unit 3 includes a honing or cutting element 12 which serves to treat the cutting edge 13 (FIG. 6) of a blade 5 or 6 as that blade is moved across the element 12. Those two elements 12 are disposed adjacent the open front 9 of the housing 2 so as to act on substantially the full length of the scissor blades 5 and 6 as those blades are moved into the housing 2. Preferably, each element 12 is of the cutting type in that it removes metal from a blade 5 or 6 to effect sharpening. In the construction shown, each cutting element 12 comprises a cutter plate which is rigidly secured to a support block 14 and that block 14 is pivotally at 15 for movement about an axis extending transverse to the longitudinal axis of the housing 2. The cutter plate 12 extends transverse to the longitudinal axis of the housing 2, and part of that plate 12 projects above its support block 14 to define the working edge 16 of the plate 12 (see FIG. 4). The edge 16 is disposed according to the nature of the scissor blades 5 and 6 with which the device is to be used, but usually slopes downwards towards one side of the housing 2, and in that event the edge 16 of the other cutting plate 13 slopes in the same direction (FIG. 4). That is, the sharpening edges 16 of the respective sharpener units 3 are substantially parallel.

The pivotal mounting 15 of each cutting unit 3 enables it to sharpen a scissor blade 5 or 6 during movement of the scissors 7 both in and out of the housing 2. Stop means 17 are provided to limit the extent of that pivotal movement on each side of a means position, and a biasing spring 118 (FIG. 7) may be attached to or engageable with the support block 14 to bias it towards the mean position.

In the construction of FIGS. 1 to 5, each sharpener unit 3 is mounted on a carrier member 19 arranged within the housing 2 such that each unit 3 is movable towards and away from the other unit 3. The carrier members 19 are connected at their rear ends through a pivot 20 which allows separation in the manner shown in FIG. 3. The pivot 20 could extend through to one or both of the housing side walls 10 and 11 to secure the assembly of carrier members 19 within the housing 2, but it is preferred to have the rear end of the carrier members 19 free of the housing 2. In the particular embodiment of FIGS. 1 to 5, the assembly of carrier members is releasably attached to the housing 2 adjacent the open front 9 of the housing 2 and in such a way that the free rear end of the assembly 19,19 can swing up and down. That permits the assembly 19,19 to adopt a non-central position relative to the housing 2 if scissors 7 are inclined relative to the longitudinal axis of the housing during insertion into and withdrawal from the housing.

Figure 2:
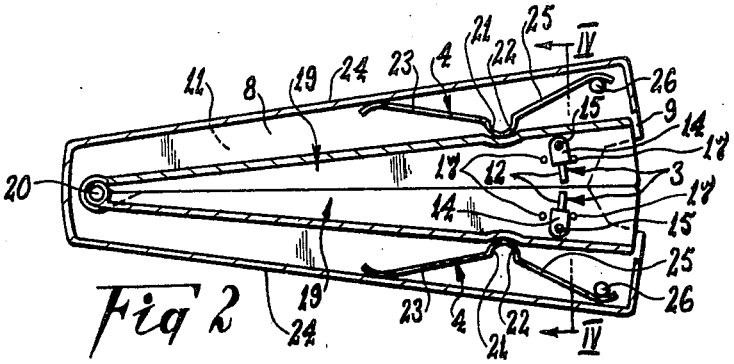
FIG. 2 is a longitudinal cross-sectional view of the construction shown in FIG. 1.
Figure 3:
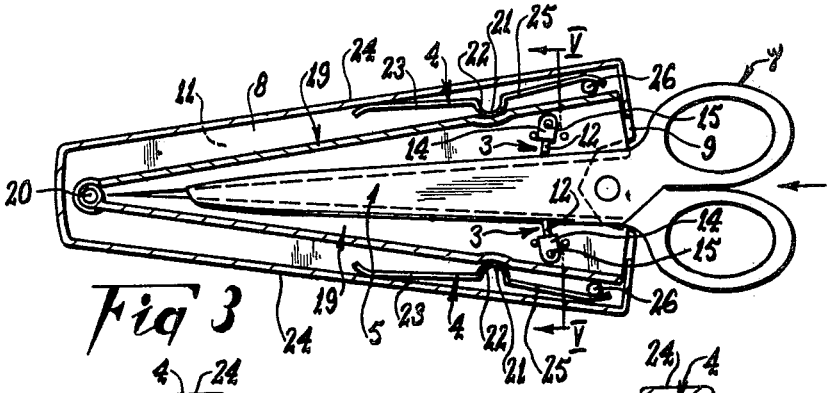
FIG. 3 is a view similar to FIG. 2 but showing scissors inserted into the scabbard.

Biasing means in the form of a leaf spring 4 acts on each carrier member 19 to urge those members into the closed position as shown in FIG. 2. Also as shown in FIGS. 2 and 3, the springs 4 serve as the means for attaching the carrier member 19 to the housing 2. That is, each spring 4 has a hump portion 21 between its ends which locates within a recess 22 of a respective carrier member 19 to releasably hold the assembly 19,19 in position within the housing 2. That form of attachment permits the carrier member assembly 19,19 to swing as required if the scissors 7 are not strictly aligned with the longitudinal axis of the housing 2 during insertion or removal. Furthermore, the attachment permits the carrier member assembly 19,19 to be removed from the housing 2 through the open front 9 for repair or replacement.

Each spring 4 has one arm 22 which bears against the underside of a respective wall 24 of the housing 2 and another arm 25 which engages a respective abutment 26 secured within the housing 2. Each abutment 26 is disposed so as to be located between the adjacent carrier member 19 and the respective spring arm 25.

In a variation of the embodiment of FIGS. 1 to 5, a single biasing spring, or other means, can act on both carrier members 19.

Figure 7:
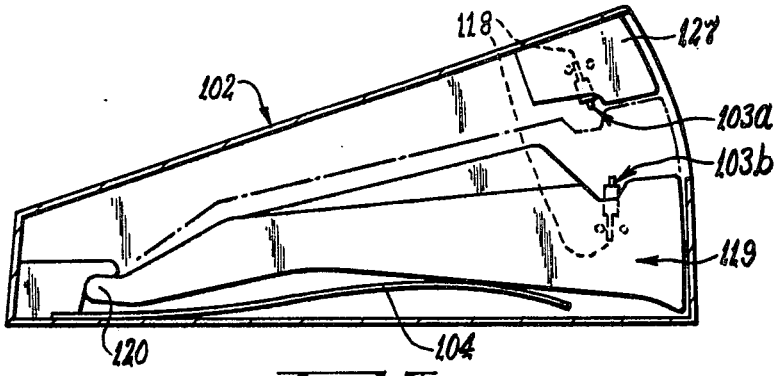
FIG. 7 is a view similar to FIG. 2 but showing an alternative embodiment of the invention.

An alternative embodiment is shown in FIG. 7 in which one sharpener unit 103*a* is secured against movement relative to the housing 102 and the other sharpener unit 103 is mounted on a carrier member 119 having its rear end 120 pivotally connected to the housing 102. A leaf spring 104 acts between the carrier member 119 and a wall 124 of the housing 102 so that the movable unit 103*b* is urged toward the other unit 103*a*. The body 127 to which the unit 103*a* is attached may be fixed to or formed integral with one or more walls of the housing 102.

In both embodiments shown, a blade guide is provided to assist in maintaining the scissor blades 5 and 6 is correct alignment with the cutter plates 12 during a sharpening operation. In the first embodiment for example, that guide is formed by a pair of spaced flanges 28 of each carrier member 19. Similar flanges may be provided in the carrier member 119 of the FIG. 7 embodiment.

Figure 5:
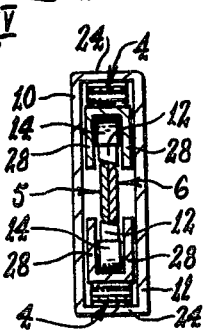
FIG. 5 is a cross-sectional view taken along line V—V of FIG. 3.

A device according to the invention is particularly effective when used with scissors 7 in which the cutting edge 13 of each blade 5 and 6 lies along, or projects beyond, the back edge 29 of the other blade when the scissors 7 are in the fully closed condition (FIG. 5). Scissors of that kind form the subject of copending patent application Ser. No. 095,270 filed Nov. 19, 1979, now U.S. Pat. No. 4,279,076.

It will be appreciated from the foregoing description that the present invention provides a convenient and effective means for sharpening scissors. The fact that the scissors can be sharpened while in the closed condition is of particular importance.

Finally, it is to be understood that various alterations, modifications and/or additions may be introduced into the constructions and arrangements of parts previously described without departing from the spirit or ambit of the invention as defined by the appended claims.

Having now described my invention, what I claim as new and desire to secure by Letters Patent is:

1. In combination, a sharpening device and scissors, the sharpening device including, a hollow housing for receiving scissor blades, a pair of sharpener units located within said housing adjacent an open front end thereof and being arranged in opposed relationship to receive said blades between them, means mounting at least one said sharpener unit for movement towards and away from the other, and biasing means acting on said movable sharpener unit to urge it in a direction towards the other said sharpener unit, the scissors having two pivotally connected blades each having a cutting edge and a back edge, the scissors having a closed condition in which the cutting edge of each blade is in substantially the same plane as the back edge of the other blade, so that upon passing the blades between the sharpener units of the sharpening device material is removed simultaneously from a respective said cutting edge and the adjacent said back edge.

2. A combination according to claim 1, wherein said mounting means includes a carrier member located within and attached to said housing for limited relative movement, said sharpener unit being secured to said carrier member.

3. A combination according to claim 2, wherein said sharpener unit mounted on said carrier member includes a support block and a plate element secured to and protruding from said support block for engagement with a scissor blade, pivot means connects said support block to said carrier member for forward and rearward pivotal movement relative to said carrier member, and stop means is provided on said carrier member for engagement with said sharpener unit to limit the extent of said pivotal movement.

4. A combination according to claim 2, wherein said biasing means includes a spring acting between said carrier member and a wall of said housing, and said carrier member is attached to said housing through engagement with said spring.

5. A combination according to claim 4, wherein said spring has a hump portion located between its ends and said carrier member has a recess which receives said hump portion to form a releasable attachment between said carrier member and said housing, an arm of said spring extending rearwardly from said hump portion bears against said housing wall, and another arm of said spring extending forwardly of said hump portion engages an abutment secured to said housing and which is located between said forward arm and said carrier member.

6. A combination according to claim 2, wherein each said sharpener unit is mounted for movement towards and away from the other and a separate said biasing means acts on each said sharpener unit.

7. A combination according to claim 6, wherein each said carrier member is elongate and extends rearwardly of its respective said sharpener unit, and pivot means connects said carrier members at their rear ends.

8. A combination according to claim 7, wherein said carrier members are removable from said housing as a single assembly.

9. A sharpening device for scissors including, a hollow housing for receiving scissor blades; a pair of sharpener units located within said housing adjacent an open front end thereof and being arranged in opposed relationship to receive said blades between them; means mounting at least one said sharpener unit for movement towards and away from the other, said mounting means including a carrier member located within and attached to said housing for limited relative movement, said movable sharpener unit being secured to said carrier member, said movable sharpener unit secured to said carrier member including a support block and a plate element secured to and protruding from said support block for engagement with one of said scissor blades; pivot means connecting said support block to said carrier member for forward and rearward pivotal movement relative to said carrier member; stop means being provided on said carrier member for engagement with said sharpener unit to limit the extent of said pivotal movement; and biasing means acting on said movable sharpener unit to urge it in a direction towards the other said sharpener unit.

10. A sharpening device for scissors including, a hollow housing for receiving scissor blades; a pair of sharpener units located within said housing adjacent an open front end thereof and being arranged in opposed relationship to receive said blades between them, means mounting at least one said sharpener unit for movement towards and away from the other, said mounting means including a carrier member located within and attached to said housing for limited relative movement, said sharpener unit being secured to said carrier member, and biasing means acting on said movable sharpener unit to urge it in a direction towards the other said sharpener unit, said biasing means including a spring acting between said carrier member and a wall of said housing, and said carrier member being attached to said housing through engagement with said spring, said spring having a hump portion located between its ends and said carrier member having a recess which receives said hump portion to form a releasable attachment between said carrier member and said housing, an arm of said spring rearwardly from said hump portion bearing against said housing wall, and another arm of said spring extending forwardly of said hump portion engaging an abutment secured to said housing and which is located between said forward arm and said carrier member.

11. A sharpening device for scissors including, a hollow housing for receiving scissor blades, a pair of sharpener units located within said housing adjacent an open front end thereof and being arranged in opposed relationship to receive said blades between them, means mounting each said sharpener unit for movement for towards and away from the other, said mounting means including two carrier members located within and attached to said housing for limited movement relative to said housing, each said sharpener unit being secured to a respective one of said carrier members, each said carrier member being elongate and extending rearwardly of its respective said sharpener unit, pivot means connecting said carrier members at their rear ends, and biasing means acting on said sharpener units to urge them towards each other.

12. A sharpening device according to claim 11, wherein said carrier members are removable from said housing as a single assembly.

* * * * *